US007021970B2

(12) United States Patent
Ozai

(10) Patent No.: US 7,021,970 B2
(45) Date of Patent: Apr. 4, 2006

(54) CONNECTOR

(75) Inventor: Kazuyuki Ozai, Tokyo (JP)

(73) Assignee: DDK Ltd., (JP)

( * ) Notice: Subject to any disclaimer, the term of this patent is extended or adjusted under 35 U.S.C. 154(b) by 0 days.

(21) Appl. No.: 10/246,490

(22) Filed: Sep. 18, 2002

(65) Prior Publication Data

US 2003/0060086 A1 Mar. 27, 2003

(30) Foreign Application Priority Data

Sep. 27, 2001 (JP) ..... 2001-296508

(51) Int. Cl.
*H01R 24/00* (2006.01)

(52) U.S. Cl. ..... 439/660

(58) Field of Classification Search ..... 439/874, 439/660, 497, 633
See application file for complete search history.

(56) References Cited

U.S. PATENT DOCUMENTS 3,088,191 A * 5/1963 Breiling ..... 29/846
3,634,806 A * 1/1972 Fergusson ..... 439/497
3,748,631 A * 7/1973 Brorein ..... 439/633
4,168,876 A * 9/1979 Balde ..... 439/499
4,884,983 A * 12/1989 Morrison ..... 439/874
4,926,548 A * 5/1990 Hopkins et al. ..... 29/860
6,142,838 A * 11/2000 Shinchi ..... 439/874

FOREIGN PATENT DOCUMENTS

JP 08-148240 6/1996

* cited by examiner

*Primary Examiner*—Phuong Dinh
(74) *Attorney, Agent, or Firm*—Baker Botts L.L.P.

(57) ABSTRACT

A connector includes a block and a required number of contacts held and fixed in the block. A plate-shaped piece made of a heat resistant and electrically insulating material is fixed to the block on that side of the contacts to which conductors are connected. The plate-shaped piece is preferably formed with grooves with a predetermined interval on that surface of the piece on which the contacts are arranged. With this construction, it is possible to provide an improved connector which is able to prevent the block from being deformed due to heating in soldering and welding when connecting conductors, and is free from any defective connection and failed insulation without raising the manufacturing and operating cost.

3 Claims, 5 Drawing Sheets

CONNECTOR

BACKGROUND OF THE INVENTION

This invention relates to a connector for use in a personal computer or the like, and more particularly to a connector provided with a plate-shaped piece of a highly heat-resistant material arranged on that side to which conductors are connected.

A hitherto used connector will be explained by referring to a perspective view of FIG. 5. The connector 40 of the prior art substantially consists of signal contacts 44, ground contacts 46 and a block 42. The signal contacts 44 and the ground contacts 46 are alternately arranged. Each of the signal contacts 44 consists of a contact portion 26 adapted to contact a mating contact, a fixed portion to be held and fixed to the block 42 and a connection portion 28 to be connected to a conductor. Similarly, each of the ground contacts 46 consists of a contact portion 26', a fixed portion and a connection portion 28' having the same functions as those in the signal contact 44.

Connected to the connection portion 28 or 28' of the signal or ground contact 44 or 46 is a conductor of a cable, flexible printed circuit board (referred to hereinafter as "FPC"), flexible flat cable (referred to hereinafter as "FFC") or the like by means of soldering, welding or the like.

Preferred materials from which to form the block include polybutylene terephthalate (PBT), liquid crystal polymer (LCP), polyamide (46 PA or 66 PA), polyphenylene sulfide (PPS) and the like in view of the requirements imposed on the block with respect to heat-resistance, stability in dimension, electrical insulating property and the like.

In order to guide the signal contacts 44 and the ground contacts 46, the block 42 is often provided with protrusion 48 extending from the main body 22 of the block 42 on that side to which conductors are connected as shown in FIG. 5.

As described above, cables, or conductors of FPC or FFC are connected to the signal contacts and ground contacts by soldering or welding, so that a comparatively highly heat-resistant material is used to form the block. The temperature at which thermal deformation of such a material may occur is 220° C. to 270° C. and its melting point is 220° C. to 300° C. In soldering or welding, however, the temperature instantaneously rises to about 300° C. to 1,000° C. and the temperature in use becomes approximately 300° C., so that such heated conditions would give rise to deformation of the block, defective connection, failed insulation and the like, which are serious problems to be solved. The thermal deformation of the block leads to necessity to exchange the connector itself resulting in increased operating cost.

SUMMARY OF THE INVENTION

It is an object of the invention to provide an improved connector capable of preventing its block from being deformed by heating in soldering or welding when connecting conductors, avoiding any defective connection and failed insulation, and preventing increase in manufacturing and operating cost to overcome all the disadvantages of the prior art.

In order to accomplish the object, in a connector including a block and a required number of contacts held and fixed in the block, according to the invention there is provided a plate-shaped piece made of a heat-resistant and electrically insulating material and fixed to the block on that side of the contacts to which conductors are connected.

The plate-shaped piece is preferably formed with grooves having a depth in a thickness direction of the piece with a predetermined interval on that surface of the piece on which the contacts are arranged. These grooves serve for the positioning of conductors and the respective contacts.

In a preferred embodiment, the plate-shaped piece and the block are different in heat-resistance and are integrally formed with each other. Such an integral construction ensures easy and exact positioning of the contacts.

Preferably, the plate-shaped piece is made of a ceramic material which is not thermally deformed even at 2,000° C. to 3,000° C. The plate-shaped piece and the block different in heat-resistance are in an integral construction formed by integrally forming the two members in one piece at a time or by separately forming the two members and then joined with each other.

The connector thus constructed according to the invention brings about significant effects as follows.

(1) According to the invention there is provided on the side of connecting conductors the plate-shaped piece made of a material having a high heat-resistance sufficiently resisting to the heating occurring when connecting conductors to prevent the block and the plate-shaped piece from being thermally deformed when connecting the conductors, thereby providing stable connection of the connector.

(2) According to the invention the plate-shaped peace is formed with grooves serving for guides for conductors (for example, cables or conductors of FPC, FFC and the like) and guides for the contacts, thereby obtaining the stable connection of the connector.

(3) According to the invention the block and the plate-shaped piece are formed of materials different in heat-resistance to eliminate thermal deformations when connecting conductors.

(4) According to the invention the block and the plate-shaped piece are in an integral construction which is formed by integrally forming the two members in one piece at a time or by separately forming the two members and then joining them with each other, thereby achieving more stable connection of conductors and more easy and exact positioning of the contacts.

(5) According to the invention the plate-shaped piece is made of a material having a melting point which is higher than 400° C. to eliminate deformations of the block and the plate-shaped piece and hence to prevent any defective or failed connection.

The invention will be more fully understood by referring to the following detailed specification and claims taken in connection with the appended drawings.

DESCRIPTION OF THE PREFERRED EMBODIMENTS

Figure 1:
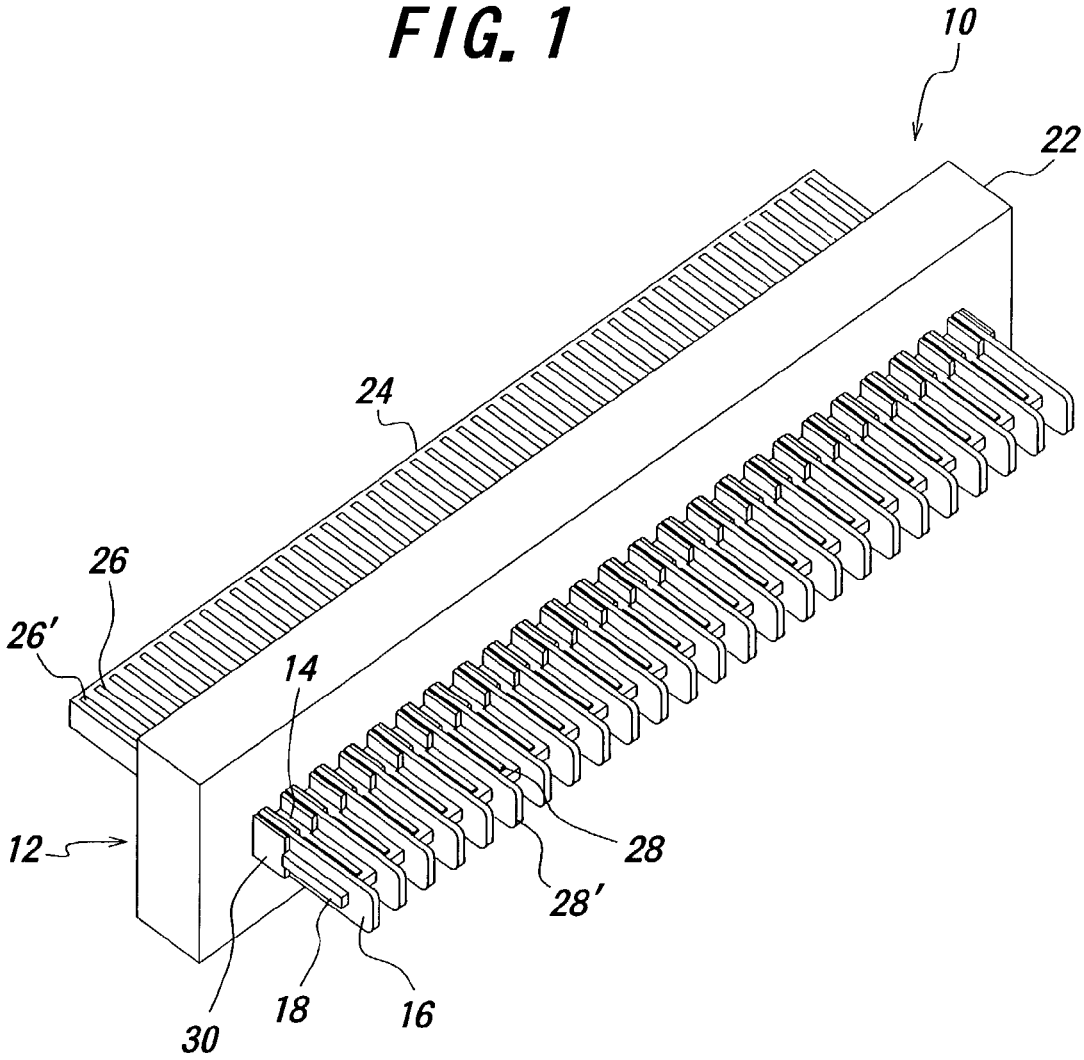
FIG. 1 is a perspective view of a connector according to the invention.
Figure 2A:
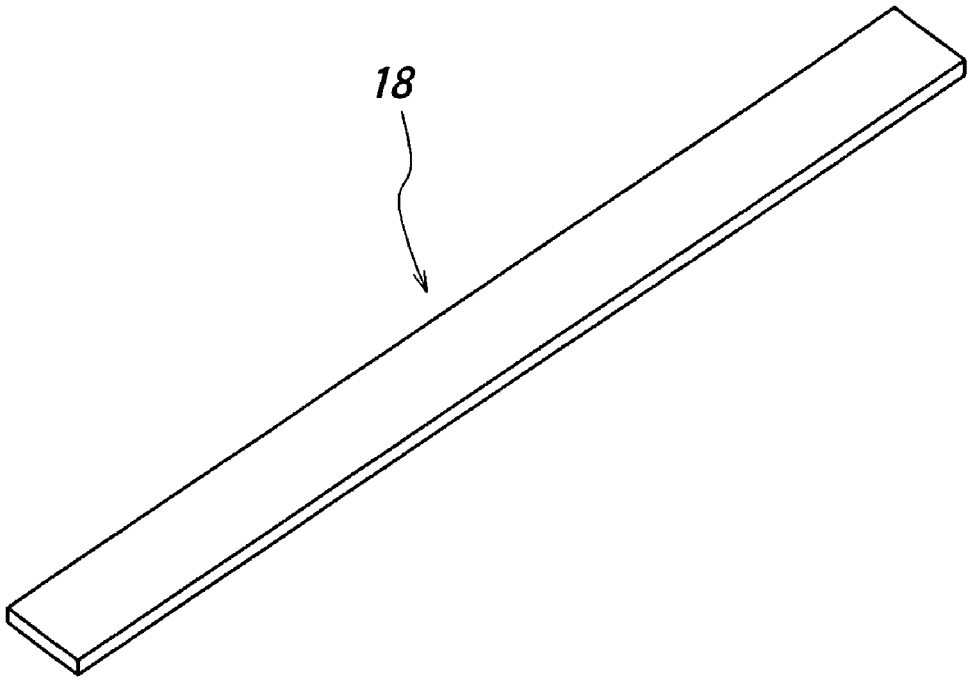
FIG. 2A is a perspective view of a plate-shaped piece used in the connector according to the invention.
Figure 2B:
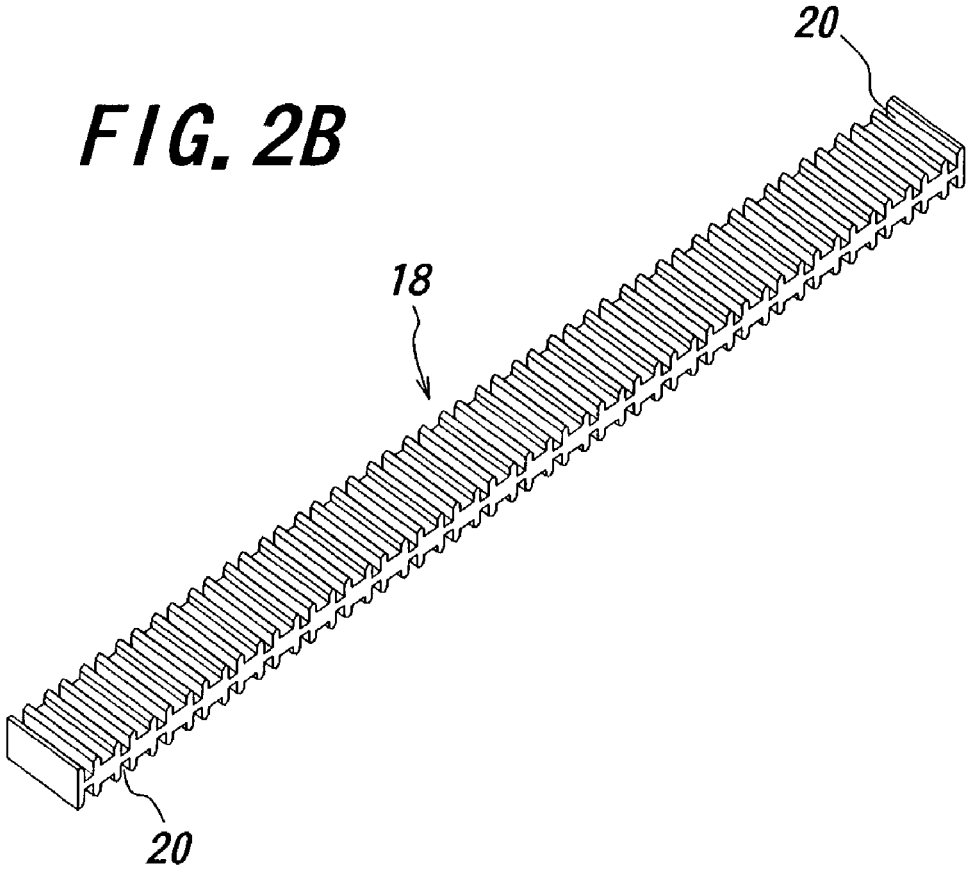
FIG. 2B is a perspective view of a plate-shaped piece formed with grooves used in the connector according to the invention.
Figure 3:
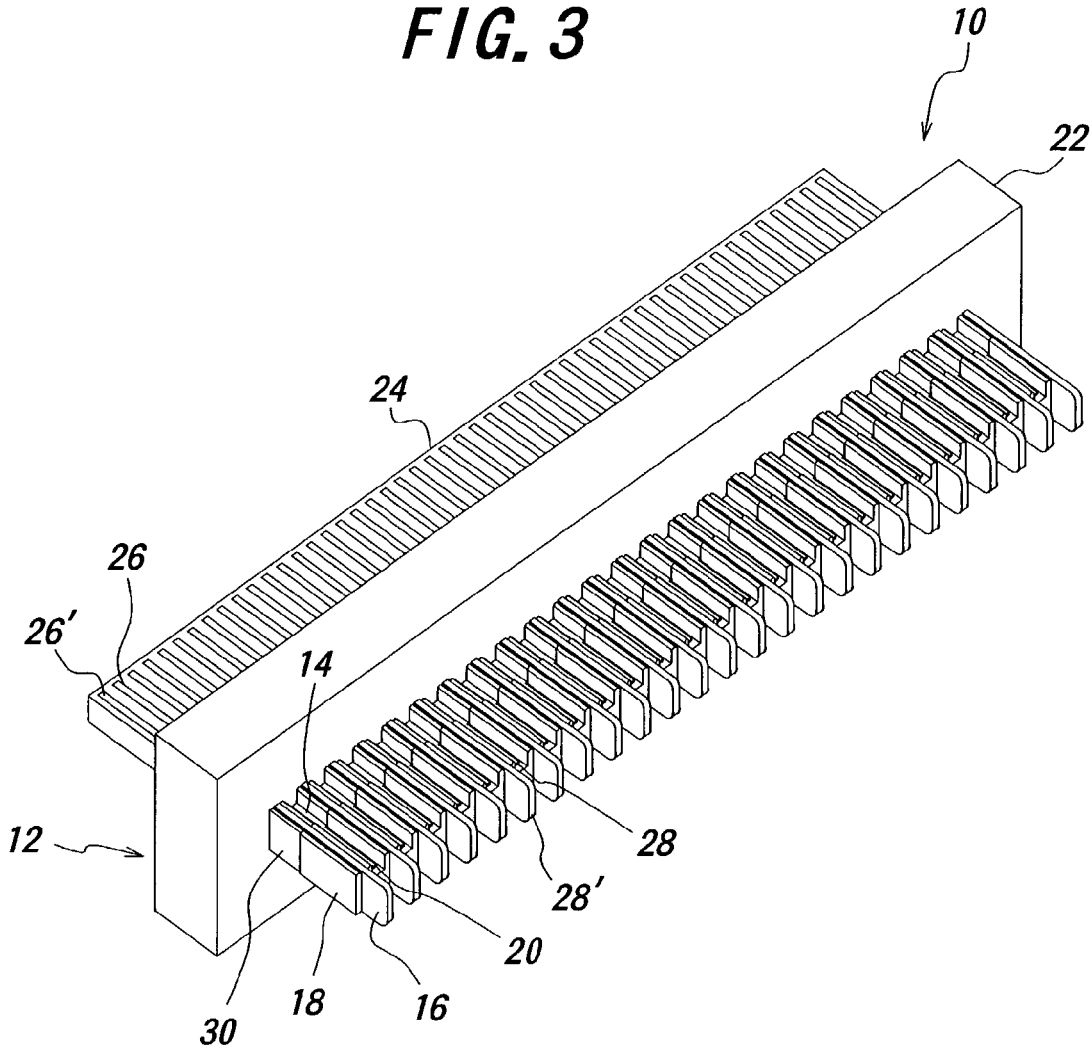
FIG. 3 is a perspective view of a connector using the plate-shaped pieces shown in FIG. 2B according to the invention.
Figure 4A:
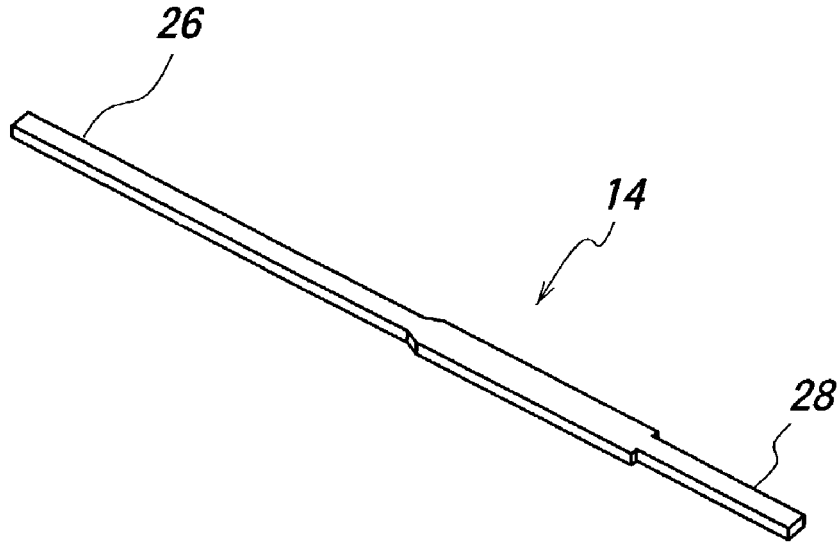
FIG. 4A is a perspective view of a signal contact used in the connector according to the invention.
Figure 4B:
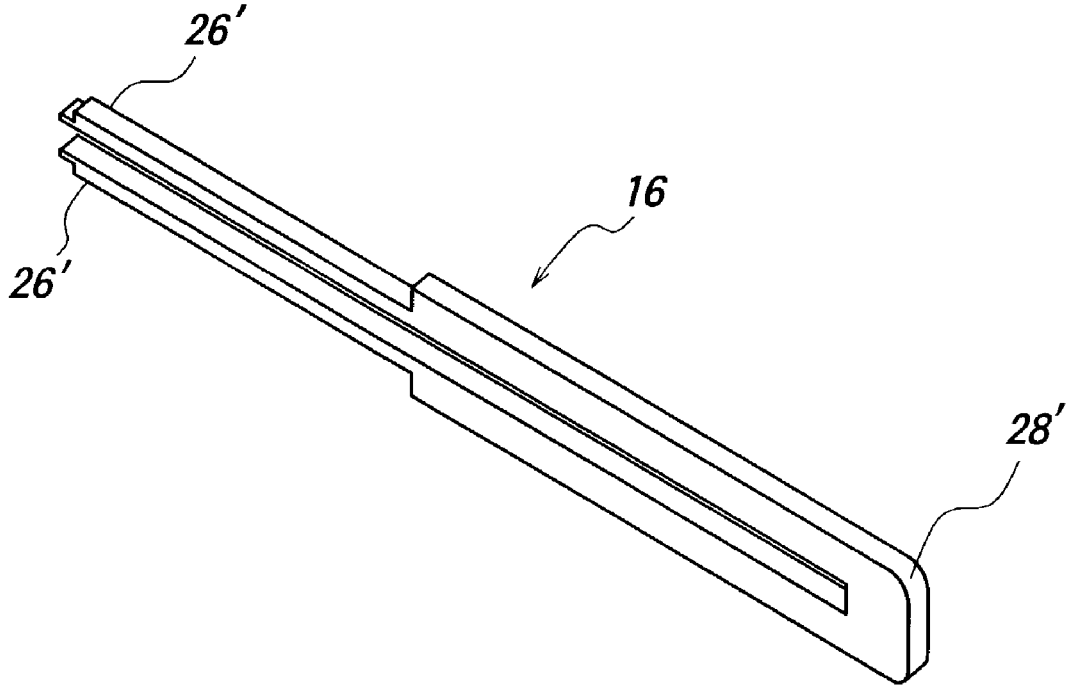
FIG. 4B is a perspective view of a ground contact used in the connector according to the invention.
Figure 5:
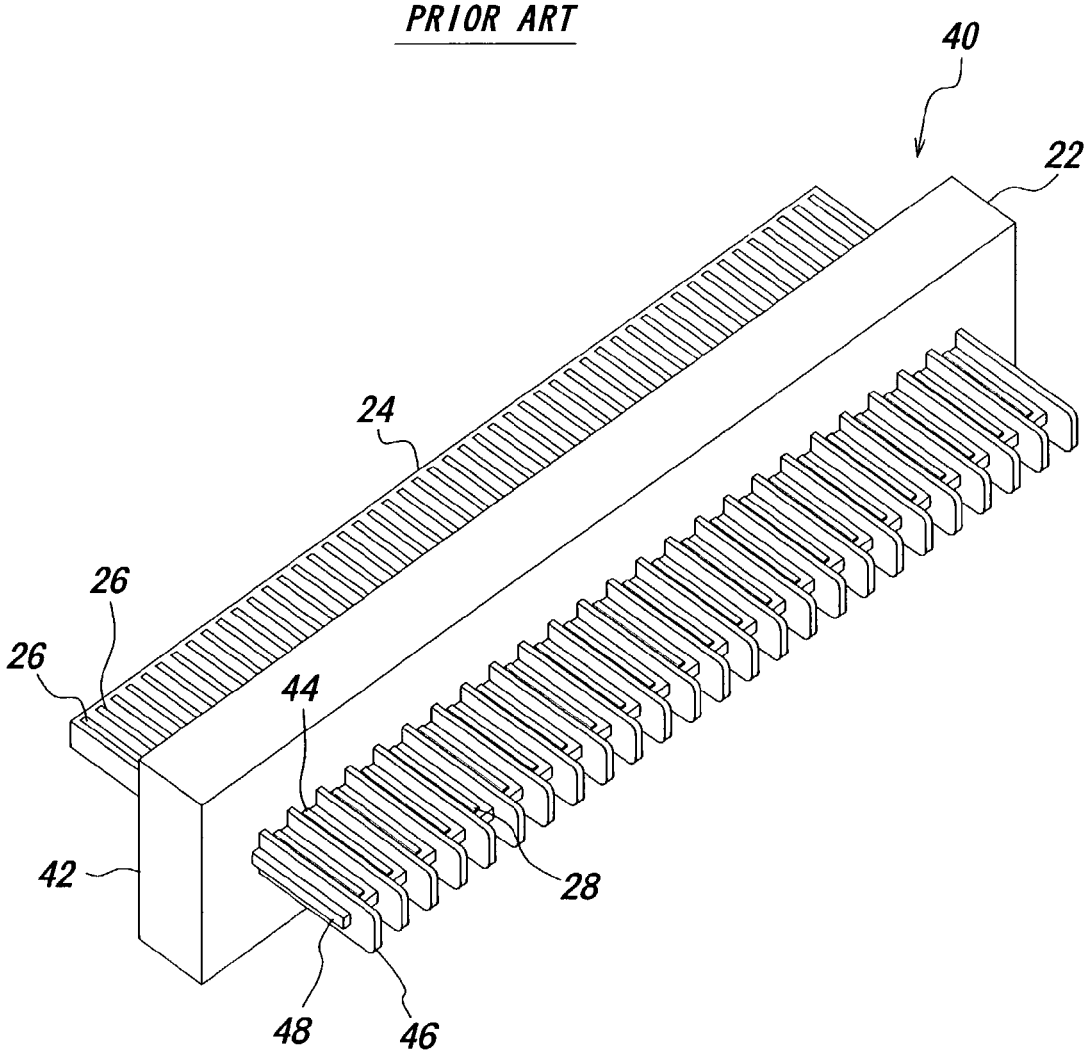
FIG. 5 PRIOR ART
FIG. 5 is a perspective view of a connector of the prior art.

FIG. 1 illustrates in a perspective view a connector according to one preferred embodiment of the invention having a plate-shaped piece, one example of which is shown in a perspective view of FIG. 2A and another example of which formed with recesses is shown in a perspective view of FIG. 2B. FIG. 3 illustrates in a perspective view a connector using the plate-shaped piece shown in FIG. 2B according to another embodiment of the present invention. FIGS. 4A and 4B illustrate in perspective views a signal contact and a ground contact to be used in the connector according to the invention, respectively.

The connector 10 according to the first embodiment of the invention comprises a required number of signal contacts 14, a required number of ground contacts 16, a block 12 and a plate-shaped piece 18. These components will be explained in detail hereinafter.

Forming an important aspect of the connector of the present invention is the plate-shaped piece 18 which will be first explained. As shown in FIGS. 1 and 3, the plate-shaped piece 18 is fixed to the block 12 on the side of conductors to be connected to the connector and serves as a guide for the conductors when being connected and a guide for the signal and ground contacts 14 and 16, and further serves to prevent thermal deformation thereof keeping the position the signal and ground contacts when connecting the conductors thereto.

The conductors may be connected to the signal and ground contacts 14 and 16 by soldering, welding or the like. The plate-shaped piece 18 will be instantaneously subjected to heat-attack at about 300° C. in soldering and at about 1,000° C. in welding, while they will experience heating at approximately 300° C. under operative conditions. In view of this fact, it is required for the material of the plate-shaped piece to have a heat-resistance at a temperature more than at least 400° C. and an electrically insulating property. Preferred materials from which to form the plate-shaped piece include ceramic materials, polyimide (PI), glass (a ceramic material in a broad sense) and the like, among them the ceramic materials being ideal from the viewpoint of the heat-resistance, workability and instantaneously high temperature to be subjected when the conductors are connected.

The size of the plate-shaped piece 18 may be suitably designed in consideration of its functions described above, the number of conductors, pitches of the contacts and the like. The plate-shaped piece 18 is fixed to the block 12 by any means so as to be integral therewith. The integral construction with the block may be accomplished by an integral forming, press-fitting, adhesion, hooking or the like.

The plate-shaped piece 18 used in the connector 10 shown in FIG. 1 is an elongated plate as shown in FIG. 2A. The plate-shaped piece 18 supports on its flat surface the signal contacts 14 and the ground contacts 16, respectively, which are alternately arranged in a row on the plate-shaped piece 18.

As shown in FIG. 2B, the plate-shaped piece 18 is preferably formed with grooves 20 having a depth in a thickness direction of the piece at least on that surface on which the contacts are arranged. The depth of the grooves 20 is suitably designed in consideration of the strength of the plate-shaped piece 18 and its functions, which is of the order of 1 mm in the illustrated embodiment. A used condition of the plate-shaped piece 18 is shown in FIG. 3, wherein the signal contacts 14 and the ground contacts 16 are fitted in the grooves 20 on the plate-shaped piece 18.

Then, the block 12 will be explained. The block 12 substantially consists of a fitting portion 24 to be fitted in a mating member, a main portion 22 to which respective contacts 14 and 16 are fixed, and an extending portion 30 extending toward conductors to be connected. The extending portion 30 not only serves to guide the respective contacts and conductors in the conventional manner but also serves to fix the plate-shaped piece. If the plate-shaped piece 18 is directly fixed to the main portion 22 of the block 12, then the extending portion 30 of the block 12 may be dispensed with.

The block 12 is formed with insertion apertures into which the required numbers of the signal contacts 14 and ground contacts 16 are inserted and fixed therein by means of press-fitting, lancing or the like. Preferred materials from which to form the block 12 include polybutylene terephthalate (PBT), polyamide (46 PA or 66 PA), liquid crystal polymer (LCP) and the like, whose melting points are of the order of 220° C. to 300° C. These materials fully comply with the imposed requirements as regards the dimensional stability, cost, moldability and strength.

As is clear from the materials of the plate-shaped piece 18 and the block 12 described above, these materials suitable for the respective members are different in heat-resistance. In more detail, the material for the plate-shaped piece 18 is at least 100° C. higher in heat-resistance (or melting point) than the material for the block 12. This is because the plate-shaped piece is required to be formed of that material whose heat-resistance is more than 100° C. higher than the temperatures used in soldering or welding.

In the illustrated embodiment, the block 12 is formed of a liquid crystal polymer (LCP) whose melting point is about 285° C., while the plate-shaped piece 18 is of a ceramic material having a melting point higher than 2,000° C. Therefore, the difference in melting point between the plate-shaped piece 18 and the block 12 is of the order of about 1,700° C., while the difference in temperature used in soldering or welding is of the order of 1,700° C., instantaneously 1,000° C. to 1,700° C.

Finally, the signal contacts 14 and the ground contacts 16 will be explained. In order to improve their transmission characteristics in the illustrated embodiment, the signal contacts 14 and the ground contacts 16 are alternately arranged. However, the signal contacts 14 only may be arranged, or each ground contact 16 may be arranged at every a few or several signal contacts 14. In other words, the arrangement of the contacts may be suitably designed according to specifications designated by customers and using purposes.

The signal contact 14 consists of a contact portion 26 adapted to contact a mating contact, a fixed portion to be fixed to the block 12 and a connection portion 28 to be connected to a conductor. Likewise, the ground contact 16 consists of a contact portion 26', a fixed portion and a connection portion 28' having the same functions as those in the signal contact 14. Preferred materials from which to form both the contacts 14 and 16 include phosphor bronze, brass, beryllium copper and the like, fulfilling the requirements with respect to electrical conductivity, springiness, low cost and the like.

Explaining further with reference to FIGS. 4A and 4B, the signal contact 14 is substantially in the form of a quadrangular prism. In the illustrated embodiment, two signal contacts 14 are arranged one upon the other on upper and lower side of the plate-shaped piece 18 viewed in the drawings so that the contact portions 26 and 26 and connection portions 28 and 28 of the two signal contacts 14 are respectively in opposition to each other.

The ground contact 16 is substantially U-shaped so that the contact portion 26' is divided into two ends 26' and 26' which are in opposition to each other like the contact portions 26 of the two signal contacts 14. The spacing between the two divided ends 26' and 26' of the contact portion extends all the way toward the connection portion 28' to form an engaging portion for receiving the plate-shaped piece 18. The engaging portion may have any size so long as it can receive a plate-shaped piece 18 and is suitably designed in consideration of the strength of the ground contact 16.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A connector comprising a block and a plate-shaped piece formed from different electrically insulating materials and having a required number of electrical contacts passing through one or more openings in said block, wherein said plate-shaped piece is fixed to said block on that side of said block where said electrical contacts are connected to conductors, wherein said plate-shaped piece is made from a heat-resistant ceramic material having a heat resistance higher than the material of said block and wherein said plate-shaped piece and said block are manufactured integrally with each other.

2. The connector of claim 1 wherein said plate-shaped piece has substantially flat top and bottom surfaces.

3. The connector of claim 1 wherein said plate-shaped piece is formed with grooves having a depth in a thickness direction of the piece with a predetermined interval on that surface of the piece in which said contacts are arranged.

* * * * *